US007133623B2

(12) United States Patent
Yoshida

(10) Patent No.: US 7,133,623 B2
(45) Date of Patent: Nov. 7, 2006

(54) IMAGE FORMING DEVICE

(75) Inventor: Seiji Yoshida, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 54 days.

(21) Appl. No.: 10/951,898

(22) Filed: Sep. 29, 2004

(65) Prior Publication Data

US 2005/0238374 A1 Oct. 27, 2005

(30) Foreign Application Priority Data

Sep. 29, 2003 (JP) ..... 2003-338640

(51) Int. Cl.
*G03G 15/00* (2006.01)

(52) U.S. Cl. ..... 399/49; 399/11

(58) Field of Classification Search ..... 347/172; 399/49, 72, 74, 46, 11
See application file for complete search history.

(56) References Cited

U.S. PATENT DOCUMENTS 6,366,306 B1 4/2002 Fukuda
6,633,734 B1 * 10/2003 Maebashi et al. ..... 399/49

FOREIGN PATENT DOCUMENTS

| | | |
|---|---|---|
| JP | A 11-164148 | 6/1999 |
| JP | A 2000-255108 | 9/2000 |
| JP | A 2000-278543 | 10/2000 |
| JP | A 2001-184182 | 7/2001 |

OTHER PUBLICATIONS

U.S. Appl. No. 09/534,026, filed Mar. 24, 2000, Ueda et al.

* cited by examiner

*Primary Examiner*—Hoang Ngo
(74) *Attorney, Agent, or Firm*—Oliff & Berridge, PLC

(57) ABSTRACT

Patches to be measured are formed (S110), density of each formed patch is measured (S120), and density of patches that are not formed is estimated from the measured density values using correspondence data representing correlation between density measurements of patches of a specific tone and density measurements of patches of tones other than the specific tone (S130). Density values for all tones are then calculated from the acquired density data by interpolation (S140) to produce correction data (calibration data) (S150). Thus estimating the density of unformed patches enables reducing a number of patches to be formed, and therefore reduces time required to form and measure the patches.

17 Claims, 13 Drawing Sheets

RELATIONSHIP BETWEEN MEASUREMENTS BY DENSITY SENSOR OF COLOR LASER PRINTER AND MEASUREMENTS BY EXTERNAL COLORIMETER (FOR CYAN)

IMAGE FORMING DEVICE

BACKGROUND OF THE INVENTION

1. Field of the Invention

The present invention relates to an image forming device for forming images on a printing medium.

2. Description of Related Art

As disclosed in Japanese patent-application publication (kokai) No. 2000-278543, a process called calibration is conventionally performed to match density of images printed by a printer to tones (density) in print data received from an application program. The calibration process produces correction data through a process described below.

Assuming a full color printer capable of printing 256 levels of each color in a CMYK process using cyan (C), magenta (M), yellow (Y), and black (K) ink, calibration patches (measurement patches) are printed as shown in FIG. 12.

The calibration patches are printed in four rows corresponding to the four colors CMYK, and nine patches (patterns of any desired shape each printed at a uniform color density, referred to as simply "patches" below) are printed in each row. The nine patches in each row are printed by sending nine values representing tone levels 0, 32, 64, 96, 128, 160, 192, 224, and 255, that is, at increments of 31 or 32 levels.

The density of each patch is then measured with a sensor and the measured density is used as the output level. Data indicating correlation between the output levels and the tone or gradation values (input levels) sent to the printer is generated, and correction data for matching, to the measured output levels, the input levels sent to the printer is generated. For each of the nine cyan patches that were printed, for example, correction value required to acquire the ideal output level is obtained by using the actual output level acquired for each of the nine input levels. The correction data for the 247 input levels other than the nine measured input levels is interpolated from the calculated correction values using an interpolation algorithm. In this way, correction values for all input levels 0 to 255 are calculated, and all correction values are saved as the calibration data in a data file.

In subsequent printing operations, the calibration data is read from the data file, tone data contained in the print data received from the application program is converted to tone levels to be sent to the printer based on the read calibration data, and the converted tone data is then sent to the printer. Thus, the color density of the actual printer output matches the density levels (tones) contained in the print data received from the application program.

SUMMARY OF THE INVENTION

However, correction values for the patches other than the actually-printed nine patches are obtained by interpolation such as linear interpolation or quadratic curve interpolation. Hence, there is problem that, except for the output levels of the nine color density patches that were actually printed, the tone output levels that were interpolated can deviate from the ideal output levels. Such deviation can be reduced by increasing the number of patches that are actually printed and measured, but increasing the number of patches increases the time required to both prepare and measure the patches, and an extremely long time is required to complete the entire calibration process.

In addition, measuring performance can be different according to the sensor. For example, some general-purpose sensors offer good performance at low density levels, but poor performance at high density levels, and using those sensors will not produce sufficiently precise calibration data. There are, of course, sensors that offer high precision at both low and high density levels, but such sensors are typically expensive and therefore not easily incorporated into printers when cost is a concern. Accordingly, it is difficult to print numerous patches covering a wide tone range.

In view of the above-described drawbacks, it is an objective of the present invention to provide an image forming device capable of acquiring the greater number of density values than the number of patches that are actually printed.

In order to attain the above and other objects, the present invention provides an image forming device. The image forming device includes an image forming portion, a first density-measurement unit, a storage portion, and an estimating portion. The image forming portion forms, based on data indicative of tones in a predetermined entire tone range, at least one measurement patch for density correction each having density. The at least one measurement patch includes at least one specific-tone patch each corresponding to a specific tone. The first density-measurement unit measures the density of the at least one measurement patch. The storage portion stores estimation data for estimating, based on the density of the at least one specific-tone patch, density of at least one other-tone patch having a tone different from the tone of the at least one measurement patch. The estimating portion estimates the density of the at least one other-tone patch, based on both the estimation data and the density of the at least one specific-tone patch measured by the first density-measurement unit.

The present invention also provides an image forming device. The image forming device includes an image forming portion, a first density-measurement unit, a storage portion, and an estimating portion. The image forming portion forms, based on data indicative of tones in each of a plurality of colors, measurement patches for density correction in the plurality of colors. Each of the measurement patches has density. The measurement patches in each color include a specific-tone patch corresponding to a specific tone. The first density-measurement unit measures the densities of the measurement patches in the plurality of colors. The storage portion stores estimation data for each color for estimating, based on the density of the specific-tone patch, densities of other-tone patches having tones different from the tones of the measurement patches. The estimating portion estimates, for each color, the densities of the other-tone patches, based on both the estimation data and the density of the specific-tone patch measured by the first density-measurement unit.

Note that the image forming portion includes an equivalent image forming portion. The equivalent image forming portion has the same construction as the image forming portion of the image forming device, but is another image forming portion other than the image forming portion of the image forming device and has equivalent functions.

BRIEF DESCRIPTION OF THE DRAWINGS

The above and other objects, features and advantages of the invention will become more apparent from reading the following description of the preferred embodiments taken in connection with the accompanying drawings in which:

FIG. 1(*b*) is a block diagram showing a control unit of the color laser printer in FIG. 1 and other devices connected with one another;

FIG. 4(*b*) is an explanatory diagram showing relationships between density values of patches on an intermediate transfer belt and density values for patches printed on paper that are converted based on conversion data or estimated based on correspondence data;

DETAILED DESCRIPTION OF THE PREFERRED EMBODIMENTS

Figure 1A:
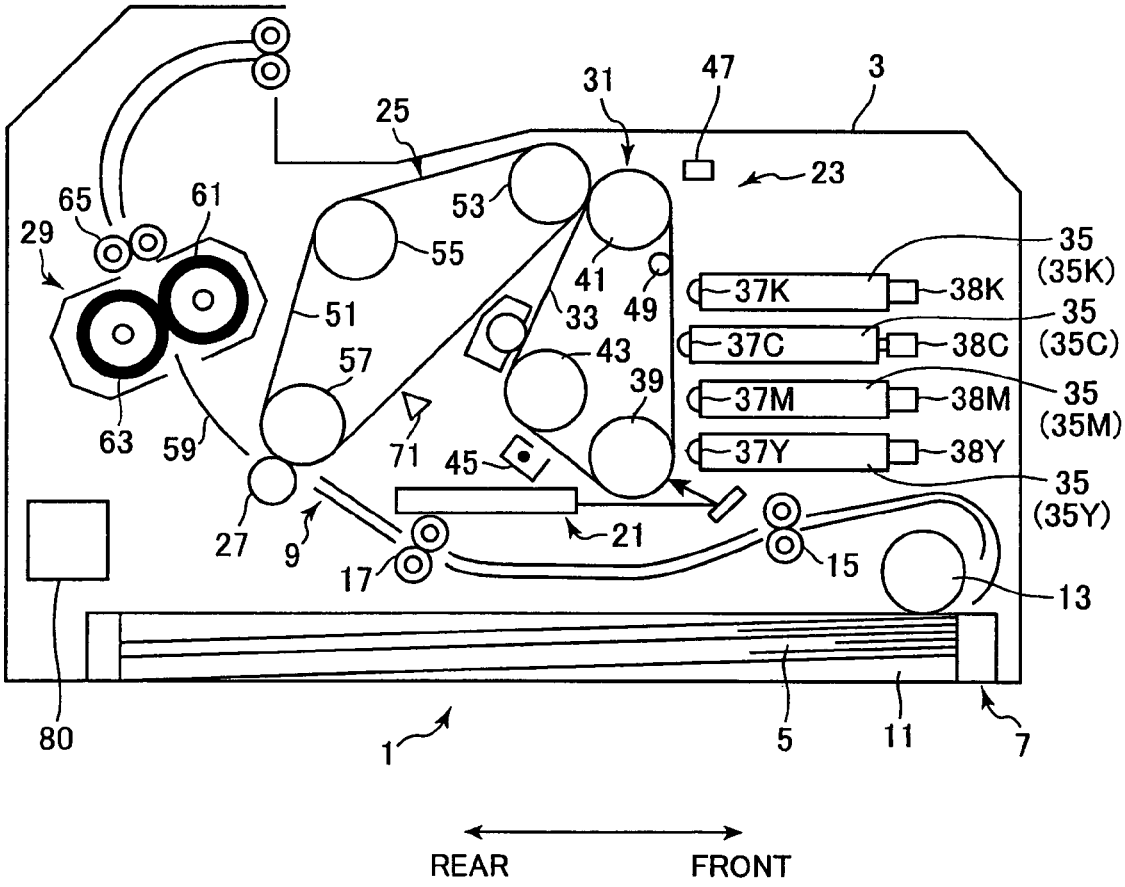
FIG. 1(*a*) is a side cross-sectional view showing a four-cycle color laser printer according to an embodiment of the present invention.

An image forming device according to preferred embodiments of the present invention will be described while referring to the accompanying drawings wherein like parts and components are designated by the same reference numerals to avoid duplicating description.

Figure 1B:
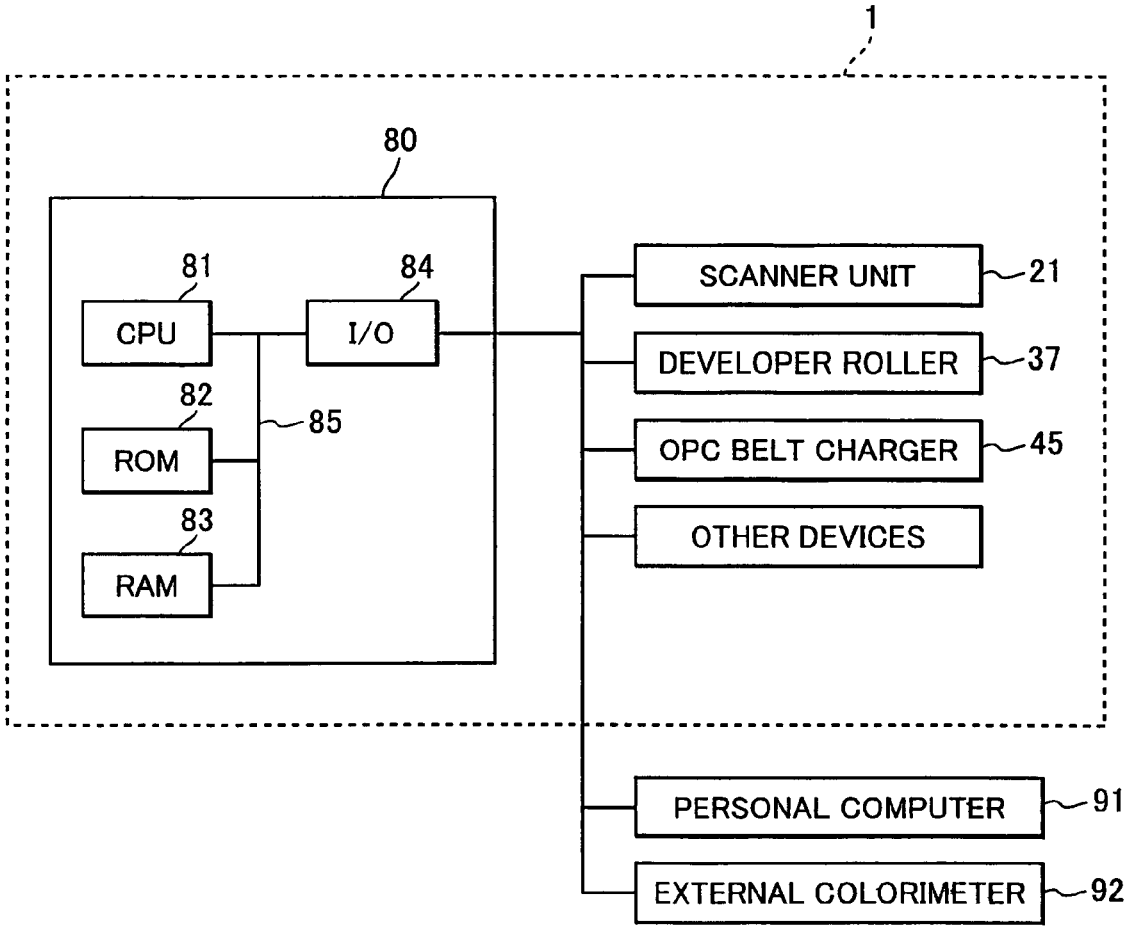

An image forming device according to the present invention is described below using a four-cycle color laser printer as an example. As shown in FIG. 1(*a*), the color laser printer 1 has a main case 3 inside of which are a paper supply unit 7 for supplying paper 5, and an image forming unit 9 for forming a specific image on the supplied paper 5.

The paper supply unit 7 includes a paper tray 11 for storing a stack of paper 5, a supply roller 13 that contacts the top sheet of paper 5 in the paper tray 11 and rotates to supply one sheet at a time to the image forming unit 9, and transportation rollers 15 and registration rollers 17 for conveying the paper 5 to an image formation position.

The image formation position is a transfer position where a toner image on an intermediate transfer belt 51 further described below is transferred to the paper 5, and is a position where the intermediate transfer belt 51 contacts the transfer roller 27 described below.

The image forming unit 9 includes a scanner unit 21, a processing unit 23, an intermediate transfer belt assembly 25, a transfer roller 27, and a fixing unit 29.

Located in the center portion of the main case 3, the scanner unit 21 has a laser unit, a polygon mirror, and a plurality of lenses and reflection mirrors (not shown). The laser beam emitted from the laser unit based on the image data is passed or reflected by the polygon mirror, reflection mirrors, and lenses in the scanner unit 21 to scan the surface of the organic photoconductor (OPC) belt 33 in the belt photoconductor assembly 31 at high speed.

The processing unit 23 includes the belt photoconductor assembly 31 and a plurality of (four) developer cartridges 35. The four developer cartridges 35, that is, the yellow developer cartridge 35Y holding yellow toner, the magenta developer cartridge 35M holding magenta toner, the cyan developer cartridge 35C holding cyan toner, and the black developer cartridge 35K holding black toner, are disposed at the front inside the main case 3 sequentially in series from bottom to top with a specific vertical gap between the adjacent cartridges.

Each of the developer cartridges 35 includes a developer roller 37 (yellow developer roller 37Y, magenta developer roller 37M, cyan developer roller 37C, and black developer roller 37K), a film thickness regulation blade (not shown), a supply roller, and a toner compartment. The developer cartridges 35 are moved horizontally to contact and separate from the surface of the OPC belt 33 by means of respective separation solenoids 38 (yellow separation solenoid 38Y, magenta separation solenoid 38M, cyan separation solenoid 38C, and black separation solenoid 38K).

The developer rollers 37 have a metal roller shaft covered with a roller made from an elastic material, specifically a conductive rubber material. More specifically, the roller part of each developer roller 37 has a two-layer construction including an elastic roller part made from a conductive urethane rubber, silicon rubber, or EPDM rubber containing carbon powder, and a coating layer of which the primary component is a urethane rubber, urethane resin, or polyimide resin. During development, a specific developer bias relative to the OPC belt 33 is applied to the developer roller 37, and a specific recovery bias is applied during toner recovery. The specific developer bias is +300 V, and the specific recovery bias is −200 V, for example.

A spherical polymer toner of a positively charged non-magnetic first component is stored in the toner compartment of each developer cartridge 35 as the developer of the respective color (yellow, magenta, cyan, black). During development, the toner is supplied by rotation of the supply roller to the developer roller 37, and is positively charged by friction between the supply roller and developer roller 37. The toner supplied to the developer roller 37 is carried by rotation of the developer roller 37 between the film thickness regulation blade and the developer roller 37, is further sufficiently charged therebetween, and is thus held on the developer roller 37 as a thin layer of a constant thickness. A reverse bias is applied to the developer roller 37 during toner recovery to recover the toner from the OPC belt 33 to the toner compartment.

The belt photoconductor assembly 31 includes a first OPC belt roller 39, a second OPC belt roller 41, a third OPC belt roller 43, the OPC belt 33 wound around the first OPC belt roller 39, the second OPC belt roller 41, and the third OPC belt roller 43, an OPC belt charger 45, a potential (voltage) applying unit 47, and a potential (voltage) gradient controller 49. The construction of the belt photoconductor assembly 31 is described in further detail below.

The intermediate transfer belt assembly 25 is disposed behind the belt photoconductor assembly 31, and includes a first ITB roller 53, second ITB roller 55, third ITB roller 57, and the intermediate transfer belt 51 wound around the outside of the first to third ITB rollers 53 to 57. The first ITB roller 53 is located substantially opposite the second OPC belt roller 41 with the OPC belt 33 and intermediate transfer belt 51 therebetween. The second ITB roller 55 is located diagonally lower than and behind the first ITB roller 53. The third ITB roller 57 is located behind the second ITB roller 55 and opposite the transfer roller 27 with the intermediate transfer belt 51 therebetween.

The intermediate transfer belt 51 is an endless belt made from a conductive polycarbonate or polyimide resin, for example, containing a dispersion of conductive powder such as carbon.

The first ITB roller 53, second ITB roller 55, and third ITB roller 57 are arranged in a triangle around which the intermediate transfer belt 51 is wrapped. When the first ITB roller 53 is rotationally driven via drive gears by driving a main motor (not shown), the second ITB roller 55 and third ITB roller 57 follow, and the intermediate transfer belt 51 thus moves circularly clockwise around the first to third ITB rollers 53 to 57.

A density detection sensor 71 is provided for detecting density of each color patch on the intermediate transfer belt 51. The density detection sensor 71 includes a light source for emitting light in the red spectrum, a lens for directing the emitted light to the intermediate transfer belt 51, and a phototransistor for detecting the light reflected from the intermediate transfer belt 51.

The transfer roller 27 is rotationally supported opposite the third ITB roller 57 of the intermediate transfer belt assembly 25 with the intermediate transfer belt 51 therebetween, and includes a conductive rubber roller covering a metal roller shaft. The transfer roller 27 is movable between a standby position where the transfer roller 27 is separated from the intermediate transfer belt 51, and a transfer position where the transfer roller 27 contacts the intermediate transfer belt 51, by a transfer roller separation mechanism (not shown). The transfer roller separation mechanism is disposed on both sides of the paper 5 transportation path 59 in the widthwise direction of the paper 5, and presses the paper 5 conveyed through the transportation path 59 to the intermediate transfer belt 51 when set to the transfer position.

The transfer roller 27 is set to the standby position while visible images of each color are sequentially transferred to the intermediate transfer belt 51, and is set to the transfer position when all of the images have been transferred from the OPC belt 33 to the intermediate transfer belt 51 and a color image has thus been formed on the intermediate transfer belt 51. The transfer roller 27 is also set to the standby position during a calibration process described later.

When in the transfer position, a specific transfer bias relative to the intermediate transfer belt 51 is applied to the transfer roller 27 by a transfer bias application circuit (not shown).

The fixing unit 29 is located downstream from the intermediate transfer belt assembly 25, and includes a heat roller 61, a pressure roller 63 for pressing the printing medium to the heat roller 61, and a first transportation roller 65 disposed downstream from the heat roller 61 and pressure roller 63. The heat roller 61 has an outside layer of silicon rubber covering an inside metal layer, and a halogen lamp as the heat source.

The belt photoconductor assembly 31 of the image forming unit 9 is described in further detail below. The first OPC belt roller 39 is located opposite and behind the four developer cartridges 35 at a position below the lowest cartridge, that is, yellow developer cartridge 35Y. The first OPC belt roller 39 is a driven roller that rotates following the drive roller.

The second OPC belt roller 41 is located vertically above the first OPC belt roller 39 at a height above the top cartridge, that is, the black developer cartridge 35K. The second OPC belt roller 41 is a drive roller that rotates when driven by a main motor (not shown) via drive gears (not shown).

The third OPC belt roller 43 is located diagonally behind and above the first OPC belt roller 39. The third OPC belt roller 43 is also a driven roller that rotates following the drive roller. The first OPC belt roller 39, second OPC belt roller 41, and third OPC belt roller 43 are thus arranged in a triangle.

The second OPC belt roller 41 is charged to a potential of +800 V (volts) by a proximally located potential applying unit 47 using power from the OPC belt charger 45.

The first OPC belt roller 39 and third OPC belt roller 43 are made from a conductive material such as aluminum, contact the base layer (described below) of the OPC belt 33, and are connected to a ground terminal (not shown). In other words, the first OPC belt roller 39 and third OPC belt roller 43 hold the potential of the OPC belt 33 to ground in the area where the rollers contact the belt.

The OPC belt 33 is wound around the first OPC belt roller 39, second OPC belt roller 41, and third OPC belt roller 43. When the second OPC belt roller 41 is rotationally driven, the first OPC belt roller 39 and third OPC belt roller 43 also rotate, and the OPC belt 33 moves circularly counterclockwise.

The OPC belt 33 is an endless belt having a 0.08 mm thick base layer (conductive base layer) with a 25 μm thick photosensitive layer formed on one side of the base layer. The base layer is a nickel conductor formed by nickel electroforming. The photosensitive layer is a polycarbonate photoconductor.

As shown in FIG. 1(*a*), the OPC belt charger 45 is located below the belt photoconductor assembly 31 in the neighborhood of the first OPC belt roller 39 at a position upstream of the part of the OPC belt 33 exposed by the scanner unit 21 opposite the OPC belt 33 with a specific gap therebetween so that the OPC belt charger 45 does not contact the OPC belt 33. The OPC belt charger 45 is a scorotron charger for positively charging the belt by generating a corona discharge from a tungsten or other charging wire, and uniformly positively charges the surface of the OPC belt 33.

The potential gradient controller 49 is located between the second OPC belt roller 41 and first OPC belt roller 39, and contacts the base layer of the OPC belt 33 at a position above the black developer cartridge 35K. The potential gradient controller 49 lowers the potential of the base layer to ground at the point of contact.

As shown in FIG. 1(*b*), a control unit 80 includes a common microcomputer having a CPU 81, a ROM 82, a RAM 83, an input/output interface (I/O) 84, and interconnecting bus lines 85. The CPU 81, the ROM 82, and the RAM 83 are connected, via the I/O 84, with the scanner unit 21, the developer roller 37, the OPC belt charger 45, and other devices of the color laser printer 1. The CPU 81, the ROM 82, and the RAM 83 can also be connected, via the I/O 84, with a personal computer 91 and an external colorimeter 92. The personal computer 91 stores and executes application programs. The personal computer 91 sends print data (color data, tone data, and the like) to the control unit 80 of the color laser printer 1 via the I/O 84.

The control unit 80 controls operation of the color laser printer 1 based on a program stored in the ROM 82 and the RAM 83. The control unit 80 (or more specifically the RAM 83 or the ROM 82 of the control unit 80) stores correspondence data used in the calibration process described later. In addition, the control unit 80 (or more specifically the RAM 83 of the control unit 80) can also store results from the calibration process and generated correction data.

The printing operation of the color laser printer 1 is described next. The following operations are performed by the control unit 80 controlling other devices of the color laser printer 1.

(1) The supply roller 13 applies pressure to the top sheet of paper 5 stored in the paper tray 11 of the paper supply unit 7 such that rotation of the supply roller 13 delivers the paper 5 one sheet at a time into the paper transportation path. The paper 5 is then supplied to the image formation position by the transportation rollers 15 and registration rollers 17. The registration rollers 17 register the position of the paper 5.

(2) After the surface of the OPC belt 33 is uniformly charged by the OPC belt charger 45, the OPC belt 33 is exposed by high speed scanning of the laser beam from the scanner unit 21 based on image data to be printed. Because the charge is removed from the exposed areas, an electrostatic latent image having positively charged parts and uncharged parts is formed on the surface of the OPC belt 33 according to the image data.

The first OPC belt roller 39 and third OPC belt roller 43 also supply current to the base layer of the OPC belt 33 in contact therewith, and thus hold the potential of the contact area to ground.

The yellow separation solenoid 38Y then moves the yellow developer cartridge 35Y of the plural developer cartridges 35 horizontally to the rear towards the OPC belt 33 on which the electrostatic latent image is formed (i.e., to the left in FIG. 1(*a*)) so that the developer roller 37 of the yellow developer cartridge 35Y contacts the OPC belt 33 on which the electrostatic latent image is formed.

The yellow toner in the yellow developer cartridge 35Y is positively charged, and thus adheres only to the uncharged areas of the OPC belt 33. A visible yellow image is thus formed on the OPC belt 33.

The magenta developer cartridge 35M, cyan developer cartridge 35C, and black developer cartridge 35K are each moved horizontally towards the front, that is, away from the OPC belt 33, by the respective separation solenoids 38M, 38C, 38K, and are thus separated from the OPC belt 33 at this time.

The visible yellow image formed on the OPC belt 33 is then transferred to the surface of the intermediate transfer belt 51 as the OPC belt 33 moves and contacts the intermediate transfer belt 51.

A forward bias (+300 V potential) is applied by the power supply of the OPC belt charger 45 to the second OPC belt roller 41 at this time, thereby charging the light sensitive layer of the belt near the second OPC belt roller 41 to a +300 V potential through the intervening conductive base layer. This produces a repulsive force between the positively charged yellow toner and the light sensitive layer, and facilitates transferring the toner to the intermediate transfer belt 51.

(3) An electrostatic latent image is likewise formed for magenta on the OPC belt 33, a visible magenta toner image is then formed, and the visible magenta toner image is transferred to the intermediate transfer belt 51 as described above.

More specifically, an electrostatic latent image is formed on the OPC belt 33 for the magenta image component, and the magenta developer cartridge 35M is moved horizontally by the magenta separation solenoid 38M to the back so that the developer roller 37 of the magenta developer cartridge 35M contacts the OPC belt 33. At the same time, the yellow developer cartridge 35Y, cyan developer cartridge 35C, and black developer cartridge 35K are moved horizontally to the front by the respective separation solenoids 38Y, 38C, 38K and thus separated from the OPC belt 33. As a result a visible magenta toner image is formed on the OPC belt 33 by the magenta toner stored in the magenta developer cartridge 35M. As described above, when the OPC belt 33 moves so that the magenta image is opposite the intermediate transfer belt 51, the magenta toner image is transferred to the intermediate transfer belt 51 over the previously transferred yellow toner image.

The same operation is then repeated for the cyan toner stored in the cyan developer cartridge 35C and the black toner stored in the black developer cartridge 35K, thereby forming a color image on the intermediate transfer belt 51.

(4) The color image formed on the intermediate transfer belt 51 is then transferred at once to the paper 5 by the transfer roller 27 set to the transfer position as the paper 5 passes between the intermediate transfer belt 51 and transfer roller 27.

(5) The heat roller 61 of the image forming unit 9 then thermally fuses and fixes the color image transferred to the paper 5 as the paper 5 passes between the heat roller 61 and pressure roller 63.

The first transportation roller 65 then conveys the paper 5 on which the color image was fused by the fixing unit 29 to a pair of discharge rollers. The discharge rollers then discharge the paper 5 conveyed thereto onto an exit tray formed on the top of the main case 3. The color laser printer 1 thus prints a full-color image onto the paper.

The control unit 80 executes calibration process before the above-described color printing process. The calibration process is described next with reference to the flow chart in FIG. 2.

In Step S110 of FIG. 2 (step is hereinafter abbreviated as "S"), the control unit 80 creates measurement patches. The measurement patches are created through steps (1) to (3) in the color printing process described above. More specifically, the image forming unit 9 forms the measurement patches on the intermediate transfer belt 51 before printing to the paper 5. As shown in FIG. 3, a patch column 100 is an example of the measurement patches. The patch column 100 includes a 0% tone patch 101 used in common for each color (black, cyan, magenta, yellow; referred to below as "each color") when measuring the color density, a 10% tone patch group 102, a 20% tone patch group 103 (shown in part), a 30% tone patch group (not shown), a 40% tone patch group 104 (shown in part), and a 50% tone patch group 105. Each patch group contains a patch of each color at the same tone. The individual patches are linearly contiguous, and are formed so that the entire patch column 100 is contained within one revolution of the intermediate transfer belt 51.

Figure 2:
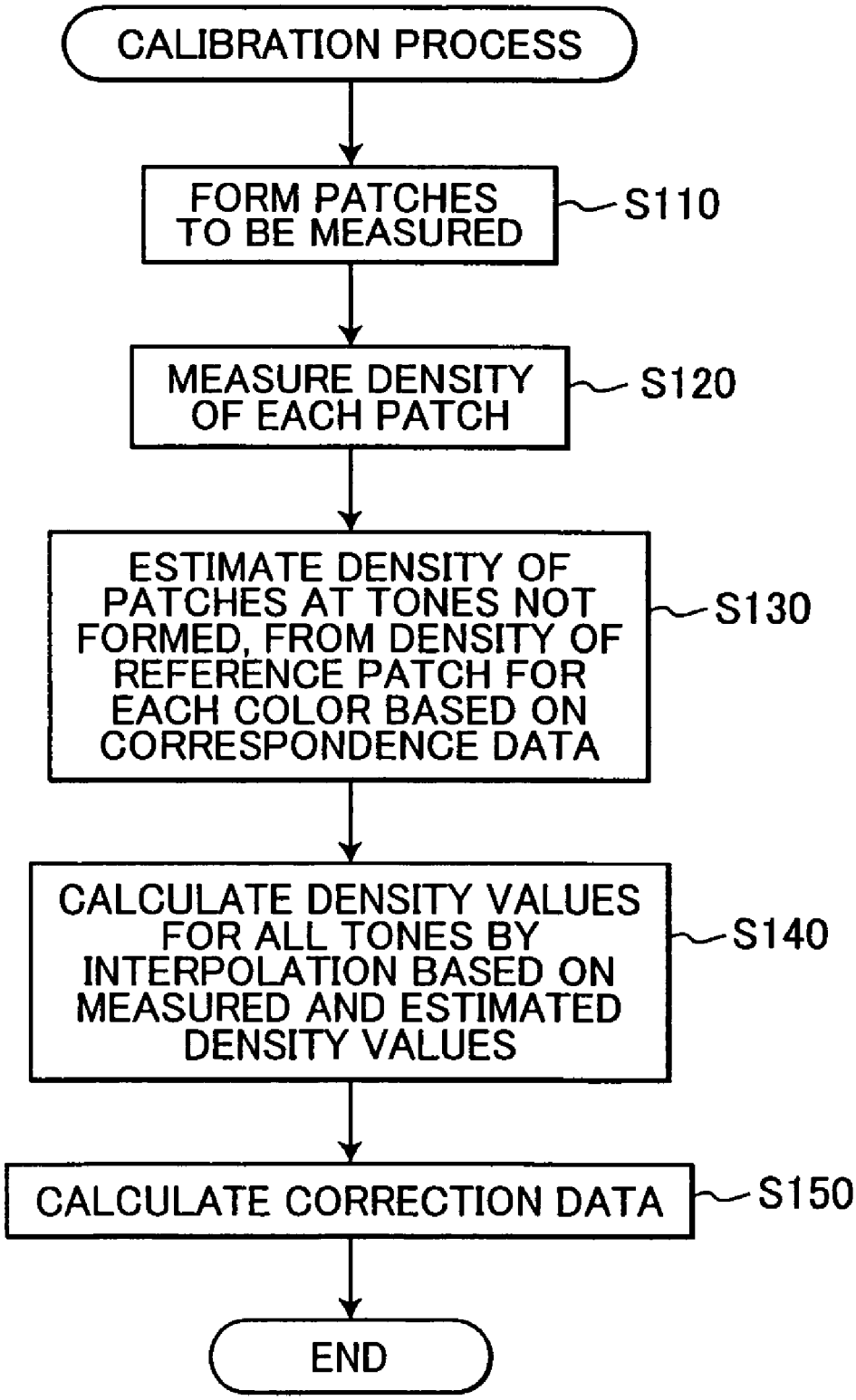
FIG. 2 is a flow chart showing a calibration process performed by the control unit of the laser printer in FIG. 1(*a*)
Figure 3:
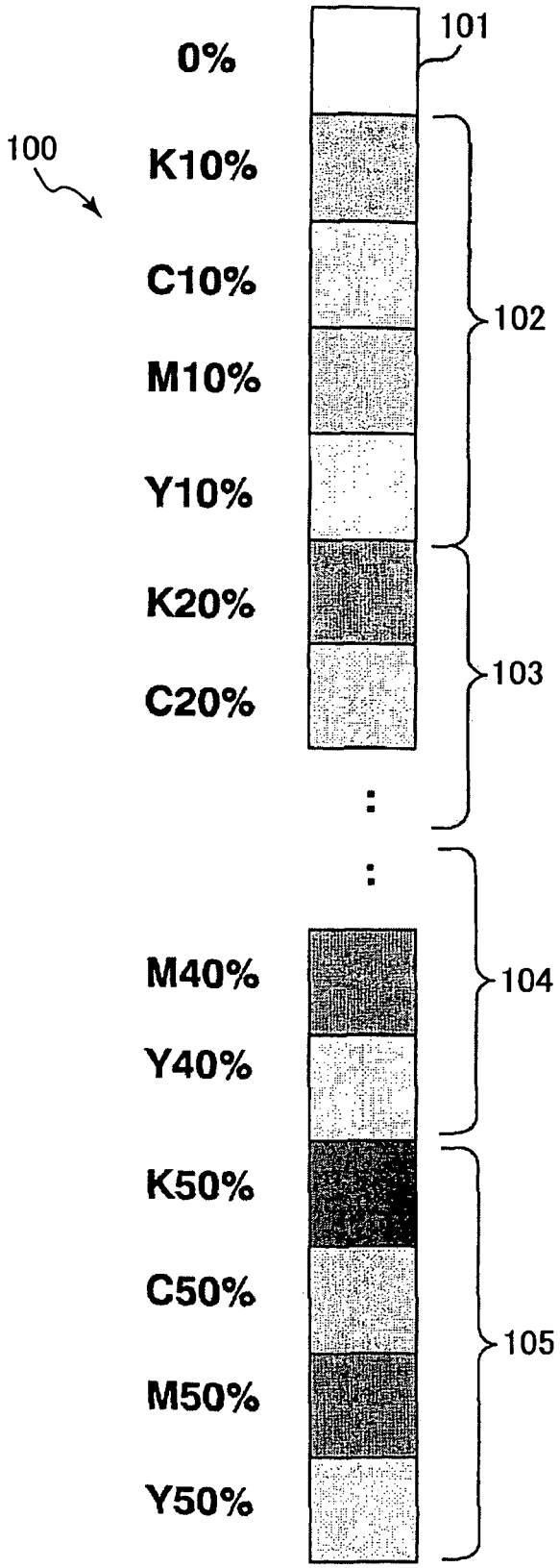
FIG. 3 is an explanatory diagram showing measurement patches used in the calibration process of FIG. 2.

In S120 in FIG. 2, the density of each patch in the patch column 100 is measured. The density detection sensor 71 measures the patch column 100 on the intermediate transfer belt 51 as the intermediate transfer belt 51 is driven circularly and passes the density detection sensor 71. Note that because the patch column 100 is formed completely within the length of one revolution of the intermediate transfer belt 51, the density detection sensor 71 can measure the density of all patches in the patch column 100 with one revolution of the intermediate transfer belt 51.

The patch column 100 includes reference patches (specific-tone patches). The reference patches are determined beforehand according to a reference-patch determination process (FIG. 7) to be described later. In this example, the 50% tone patches 105 are used as the reference patches.

In S130, the CPU 81 calculates, based on the measured density of the reference patch, estimated density for patches that are not formed. The patches that are not formed are called "other-tone patches". The estimated density is density that is obtained from the measured density when the patches are printed on paper and are measured by the external calorimeter 92 (that is, a calorimeter that is not built in to the color laser printer 1). In other words, it is possible to infer or estimate, from density of the reference patch, density of the other-tone patches when the other-tone patches are printed on paper, not on the intermediate transfer belt 51. The CPU 81 performs this estimation calculation for each color.

Figure 4A:
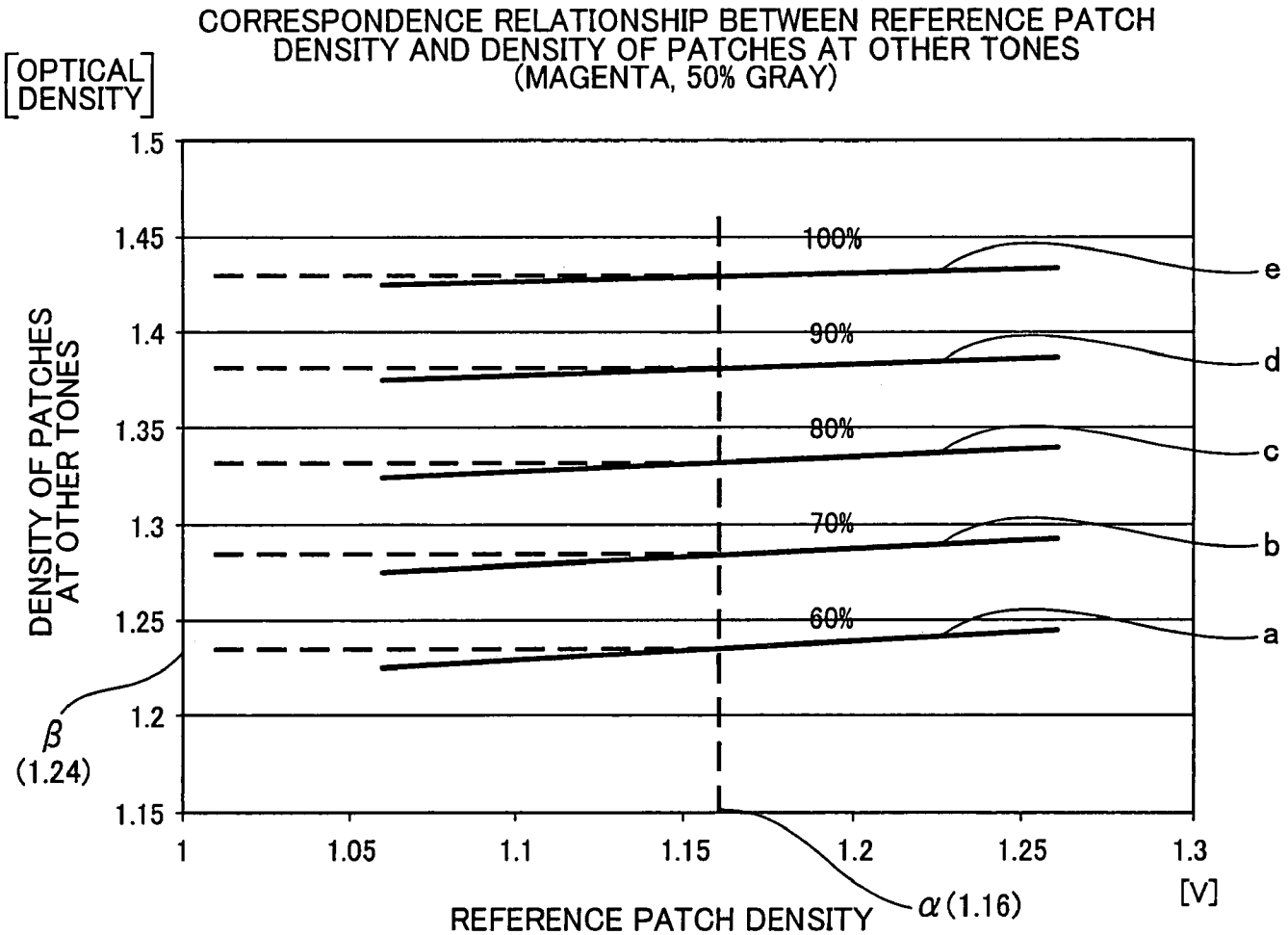
FIG. 4(*a*) is a graph showing correspondence relationship between reference patch density and density of other-tone patches.
Figure 4B:
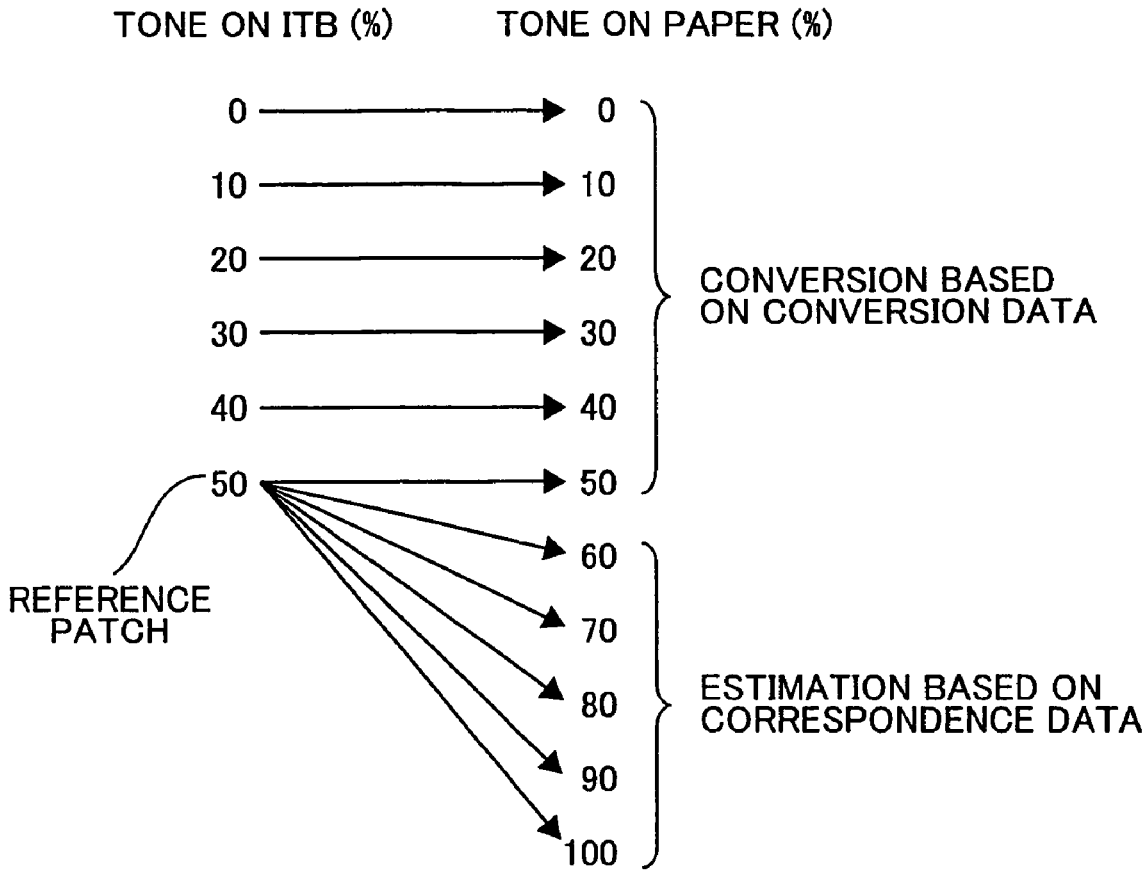

An estimation method is described below using one of the four colors as an example. As shown in FIG. 4(*a*), curves (or lines) a to e represent an example of correspondence data. The ROM 82 or RAM 83 of the control unit 80 stores the correspondence data used for the estimation. The correspondence data is data for calculating, based on a density value of the reference patch acquired by the density detection sensor 71, the estimated density of patches of other tones (other-tone patches) printed on paper.

The curve a shows the correlation of the density (the density measured by the external calorimeter 92) of a 60% tone patch to the density of the reference patch (50% tone). For example, if the measured density of the reference patch is 1.16 (point $\alpha$), the density of the 60% tone patch is estimated to be 1.24 (point $\beta$) if measured by the external calorimeter 92.

Likewise, the curve b shows the correlation of the density (the density measured by the external calorimeter 92) of a 70% tone patch to the density of the reference patch (50% tone). The curve c shows the correlation of the density (the density measured by the external calorimeter 92) of an 80% tone patch to the density of the reference patch (50% tone). The curve d shows the correlation of the density (the density measured by the external calorimeter 92) of a 90% tone patch to the density of the reference patch (50% tone). The curve e shows the correlation of the density (the density measured by the external calorimeter 92) of a 100% tone patch to the density of the reference patch (50% tone).

Thus, the control unit 80 estimates the density of patches with tones different from (other than) the reference patch tone (other-tone patches, that is, 60%, 70%, 80%, 90%, 100% tone patches) from the density measured by the density detection sensor 71 for the reference patch (50% tone) by using the correspondence data represented by the curves a to e in FIG. 4(*a*).

In this example, the measurement patch (the patch column 100) includes patches having different tones (0%, 10%, 20%, 30%, 40%, 50%). The 50% tone patches are used as the reference patches. In this case, a measurement-patch tone range is defined as a range 0% to 50% from the tones of the measurement patches (0%, 10%, 20%, 30%, 40%, 50%). The tones of the other-tone patches (60%, 70%, 80%, 90%, 100% tone patches) are outside the measurement-patch tone range (0% to 50%).

The correspondence data can be represented by mathematical equations, data sets stored in tables, a combination of equations and data sets, and so forth. Note that it is necessary that the correspondence data have a sufficient accuracy.

Figure 5:
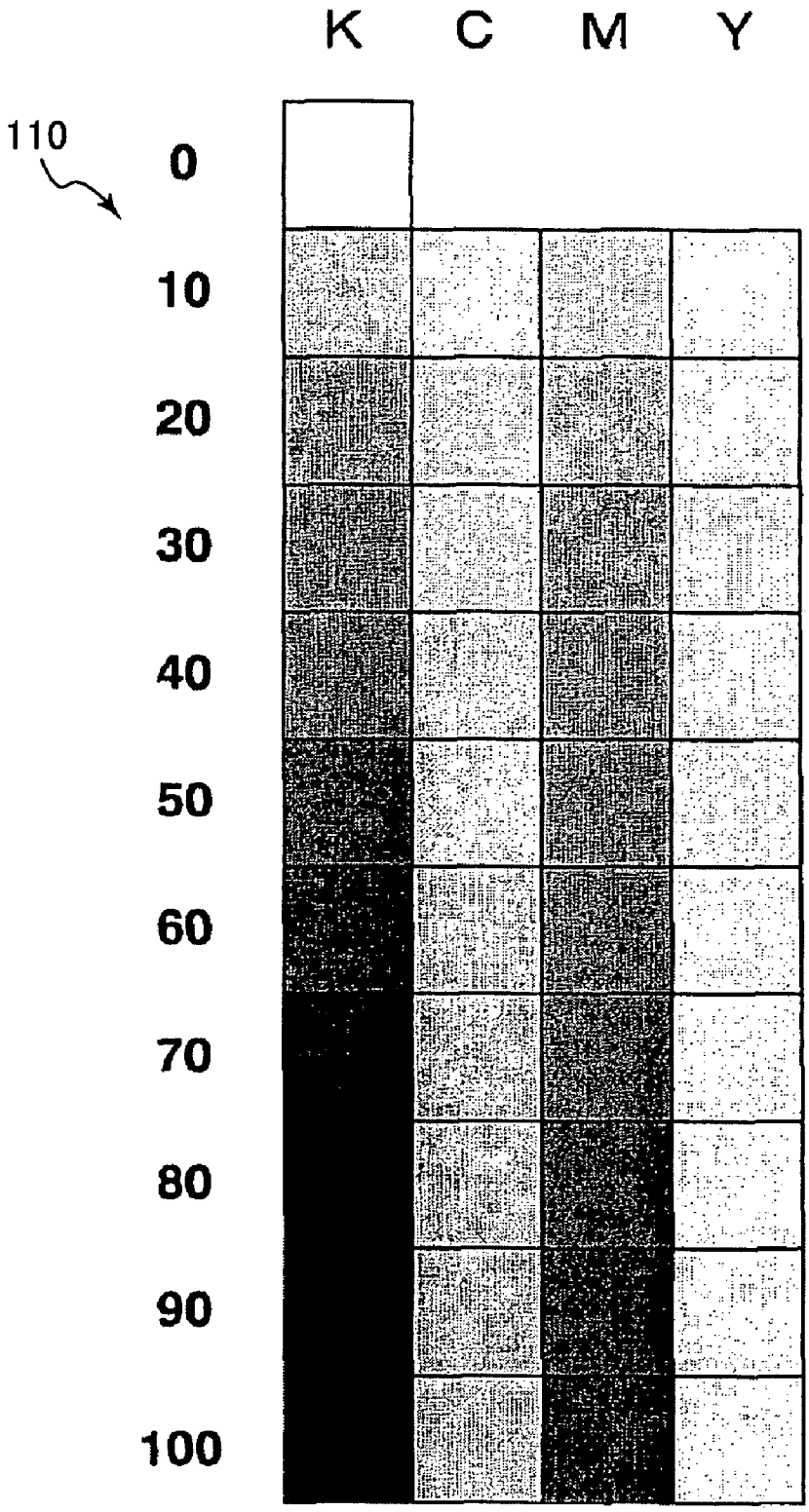
FIG. 5 is an explanatory diagram showing measurement patches for generating correspondence data.

The correspondence data can be generated by various methods. As shown in FIG. 5, in the present embodiment, measurement patches 110 are used to generate the correspondence data. The measurement patches 110 include one 0% tone patch common to each color, and ten (10) tone patches at 10% increments from 10% to 100% for each of the four colors. The density detection sensor 71 then measures the measurement patches 110, the measurement patches 110 are then actually printed onto the paper 5, the printed patches are measured using the external calorimeter 92 that is more precise than the internal density detection sensor 71, and the measurement is repeated for a plurality of samples to generate the correspondence data. At this time, preferably the measurement is repeated with different density and humidity.

More specifically, for example, the curve a in FIG. 4(*a*) is determined as described below. The density of the reference patch (50% tone patch) measured by the density detection sensor 71 is used as X (horizontal axis) value. Likewise, the density of 60% tone patch printed on paper and measured by the external calorimeter 92 is used as Y (vertical axis) value. Since the measurements are repeated as described above, a plurality of data sets (X, Y) are obtained. Thus, the curve (or line) a is determined from the plurality of data sets (X, Y) using a known method such as the least square method.

In addition to the correspondence data shown in FIG. 4(*a*), the control unit 80 stores conversion data for converting density values of the patches (0%, 10%, 20%, 30%, 40%, 50% tone) measured by the density detection sensor 71 into density values of the patches (0%, 10%, 20%, 30%, 40%, 50% tone) printed on paper. In other words, the conversion data represent relationship between density values obtained by measuring the patches (0%, 10%, 20%, 30%, 40%, 50% tone) on the intermediate transfer belt 51 with the density detection sensor 71, and density values obtained by measuring the patches (0%, 10%, 20%, 30%, 40%, 50% tone) printed on paper with the external calorimeter 92. That is, the conversion data is a simple one-to-one correspondence table. For example, the conversion data include density values obtained by measuring the 10% tone patch on the intermediate transfer belt 51 with the density detection sensor 71 and density values obtained by measuring the 10% patch printed on paper by the external calorimeter 92. The same goes for other tones such as 20%, 30%, 40%, and 50%.

In summary, as shown in FIG. 4(*b*), density values for the patches (0%, 10%, 20%, 30%, 40%, 50% tone) printed on paper can be obtained, based on the conversion data and density values of the respective patches (0%, 10%, 20%, 30%, 40%, 50% tone) on the intermediate transfer belt (ITB) 51 measured with the density detection sensor 71. On the other hand, density values for the patches (60%, 70%, 80%, 90%, 100% tone) printed on paper can be estimated, based on the correspondence data (FIG. 4(*a*)) and the density value of the reference patch (50% tone) on the intermediate transfer belt 51 measured with the density detection sensor 71.

Accordingly, density values for the patches (0%, 10%, 20%, 30%, 40%, 50%, 60%, 70%, 80%, 90%, 100% tone) printed on paper can be obtained based on density values of the patches (0%, 10%, 20%, 30%, 40%, 50% tone) on the intermediate transfer belt 51 measured with the density detection sensor 71.

In S140 in FIG. 2, density values on paper is calculated for tones other than the tones that are already obtained (that is, 0%, 10%, 20%, 30%, 40%, 50%, 60%, 70%, 80%, 90%, 100%) by applying a conventional interpolation algorithm, using both the density on paper estimated from the density values acquired by measuring the patches (0%, 10%, 20%, 30%, 40%, 50% tone) on the intermediate transfer belt 51, and the density values of the patches (60%, 70%, 80%, 90%, 100% tone) on paper estimated from the density of the reference (50% tone) patch. The conventional interpolation algorithm includes linear interpolation, quadratic interpolation, or the like. In this way, density values on the paper can be calculated for all 256 tones from 0% to 100%.

In S150, the CPU 81 calculates correction data. The correction data includes 256 data values (correction values) that convert given tones to corrected tones for obtaining ideal or desired density for each density level of all 256 tones from 0% to 100% for each of CMYK color. The given tones are, for example, tones that have been sent from an application program in the personal computer 91. The CPU 81 then stores the obtained correction values in the RAM 83 or the ROM 82 as correction data (calibration data). The calibration process then ends.

After the calibration process ends, printing can be performed. When the image forming unit 9 performs printing, the CPU 81 performs correction based on the correction data, in other words, converts the given tones to the corrected tones. The control unit 80 adjusts a pulse width of the laser beam and a voltage applied to the developer roller 37 and the OPC belt charger 45, thereby obtaining desired density for each color.

While the 50% tone patches are used as the reference patches in the calibration process described above, a different tone could be used. In general, however, there are tones at which the measurement performance of the density detection sensor 71 and the external calorimeter 92 is identical or the same, and tones at which the measurement performance differs.

Figure 6:
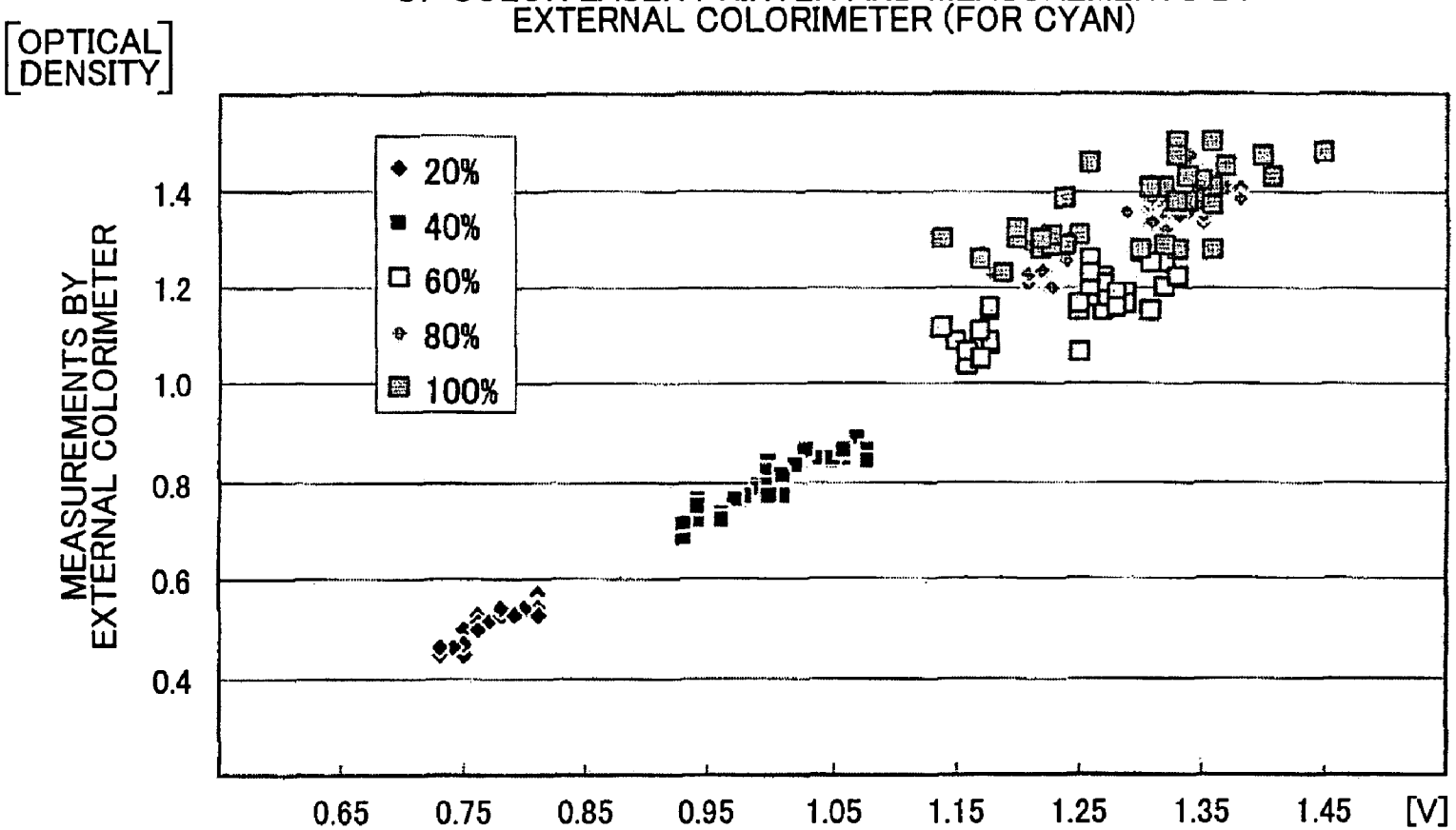
FIG. 6 is a graph showing relationship between measurements by a density sensor of the color laser printer of FIG. 1(*a*) and measurements by an external colorimeter.

For example, FIG. 6 is a graph showing density of cyan patches of 20%, 40%, 60%, 80%, and 100% tone that were measured multiple times while varying the temperature and humidity, with the density measured by the density detection sensor 71 on the x-axis and the density measured by the external calorimeter on the y-axis. As can be seen from the graph, the results at 20% and 40% are approximately linear (measurement performance is substantially the same), but it is difficult to find a linear relationship at 60%, 80%, and 100% tone (that is, measurement performance cannot be considered the same). In this case, therefore, more accurate correction data can be achieved using the 20% or 40% tone patch as the reference patch.

As described above, higher correlation is generally likely to be obtained, among various kinds of density sensors or calorimeters, with patches in low density than patches in high density. Hence, the tone of the reference patch is preferably included in a lower tone range (0% to 50%, in this example) that is lower than a center tone level (50%) at a substantially center of the entire tone range (0% to 100%).

Aging can also result in the density detection sensor 71 producing varying results when measuring the same patch a plurality of times. To prevent this problem, a tone determination process is executed as described below. The tone determination process determines a tone level that can be measured consistently or reliably even when measured a plurality of times. The patch with that tone level is used as the reference patch. In this way, the influence by aging can be suppressed at a minimum level.

The tone determination process is described with reference to the flow chart in FIG. 7.

Figure 8:
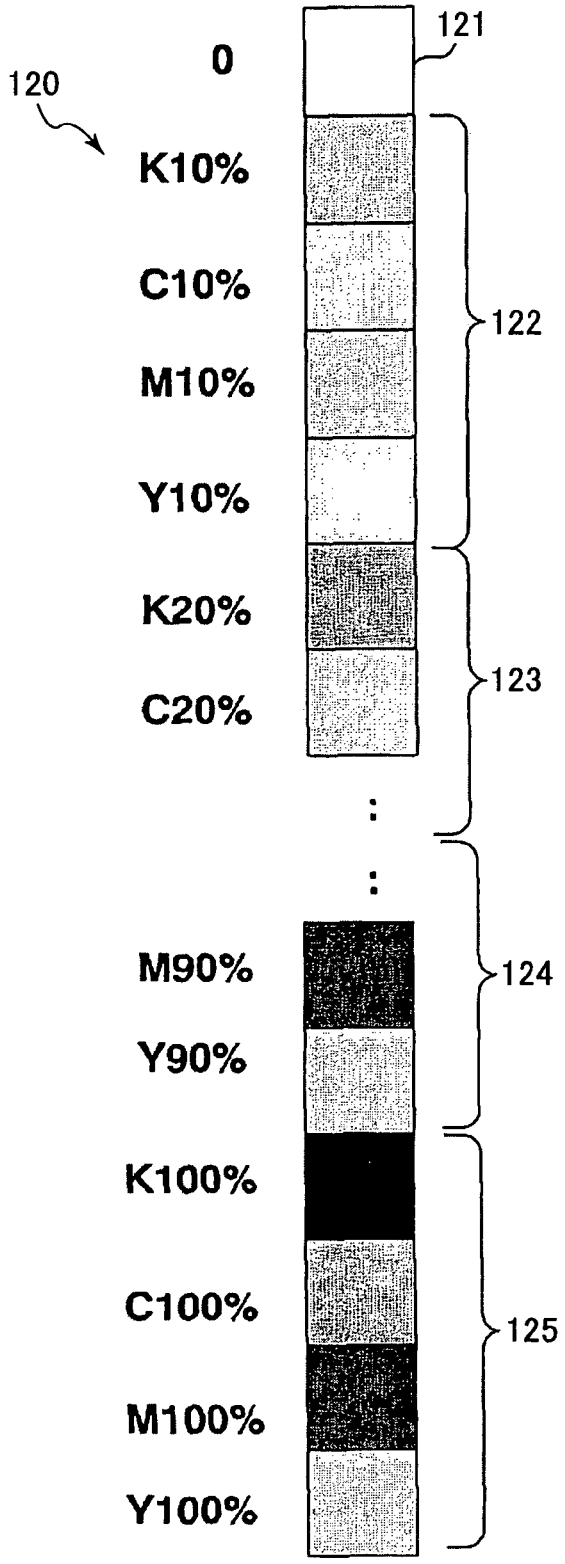
FIG. 8 is an explanatory diagram showing measurement patches used in the tone determination process of FIG. 7.

In S210, the color laser printer 1 forms the measurement patches by executing steps (1) to (3) in the color printing process described above. More specifically, the image forming unit 9 forms the measurement patches on the intermediate transfer belt 51 before printing to the paper 5. As shown in FIG. 8, a patch column 120 is an example of the measurement patches. The patch column 120 includes a 0% tone patch 121 used in common for each color when measuring color density, a 10% tone patch group 122, a 20% tone patch group 123 (shown in part), patch groups (not shown) of each color from 30% tone to 80% tone in 10% increments, a 90% tone patch group 124 (shown in part), and a 100% tone patch group 125. Each patch group contains a patch of each color at the same tone. The individual patches are linearly contiguous, and are formed so that the entire patch column 120 is contained within one revolution of the intermediate transfer belt 51.

If the full sequence of patches will not fit within the length of one revolution of the intermediate transfer belt 51, only the patches that will fit are formed and S220 is then executed. After S220 completes, the remaining patches that did not fit within the length of one revolution of the intermediate transfer belt 51 are formed, and S220 is repeated. Steps S210 and S220 are repeated until all patches are formed and measured.

Figure 7:
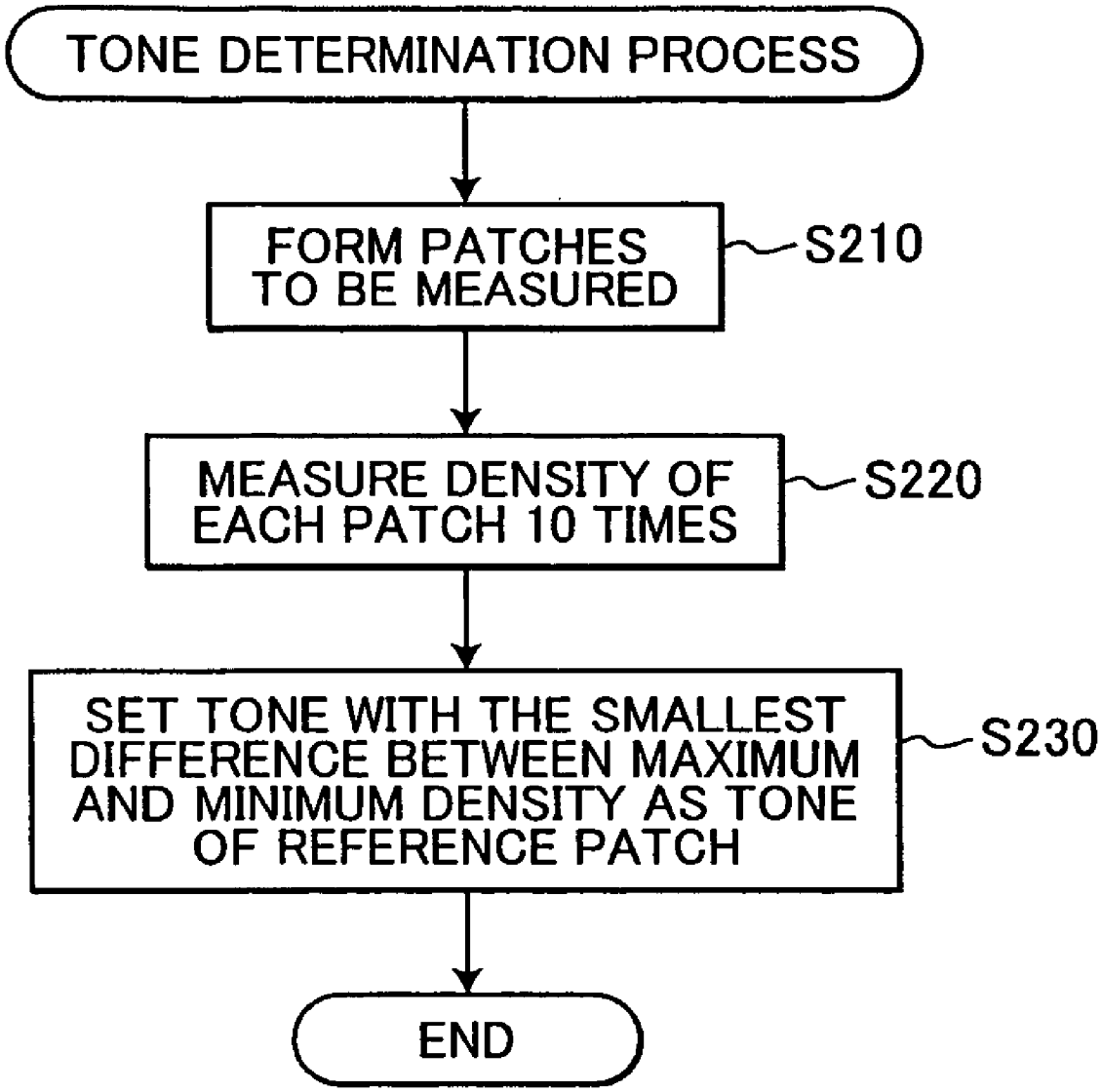
FIG. 7 is a flow chart showing tone determination process of reference patch.

As shown in FIG. 7, in S220 the density detection sensor 71 measures the density of each patch in the patch column 120 ten (10) times. The number of measurements is not limited to ten (10) and may be a different number. Each patch in the patch column 120 is a candidate for the reference patch, and thus referred to as candidate reference patch (candidate specific-tone patch).

In S230, the CPU 81 selects the tone having the smallest difference between the highest and lowest measured density, and sets that tone as the tone of the reference patch (reference-patch tone). The tone selected in this way is the tone at which the density detection sensor 71 can measure the density of the patch with the greatest consistency. Therefore, the tone is used as the tone of the reference patch.

Other methods may be used to select the tone of the reference patch. For example, one of a plurality of tones for which the difference between the highest and lowest measured color density is within a predetermined range may be randomly selected for the tone of the reference patch.

Alternatively, the control unit 80 may calculate a variation (or variance) in density in the ten-times measurements for each candidate reference patch. Then, the control unit 80 may identify the candidate reference patch having a variation in density that is smallest in the candidate reference patches, and determine the identified candidate reference patch as the reference patch. Or, the control unit 80 may identify candidate reference patches having variations in density that are smaller than a predetermined value, and determine (select) randomly one of the identified candidate reference patches as the reference patch.

Alternatively, the tones that are within the predetermined range may be selected as the tones of the patches that are formed, and not just as the tone of the reference patch. A specific example is described. In this specific example, the control unit 80 stores first correspondence data with the reference patch of 30% tone and second correspondence data with the reference patch of 50% is tone (The first correspondence data is data similar to the correspondence data shown in FIG. 4(*a*), but has the reference patch density for 30% tone patch on the horizontal axis). Also, it is assumed that density values of 10% to 40% tone (10%, 20%, 30%, and 40%) have been determined to be within the aforementioned predetermined range based on the highest and lowest measured density. In other words, the density detection sensor 71 can detect the 10% to 40% tone reliably. Hence, patches with the 10% to 40% tone are formed in this specific example. It is also assumed that a total of 21 patches can be formed within the length of one revolution of the intermediate transfer belt 51. In this case, patches for five tones in addition to a 0% tone (4 colors×5 tones+1=21 patches) can be formed within the length of one revolution of the intermediate transfer belt 51. A range of 10% to 40% is divided into substantially five equal divisions such that the patches are formed at 10%, 18%, 25%, 33%, and 40% tones. In order to estimate density values of tones outside the range 10% to 40%, it is necessary to form patches with the same tone as the reference patch for which the correspondence data is prepared. Thus, the CPU 81 finds correspondence data using the reference patch that is closest to one of the above-mentioned divided tone patch (10%, 18%, 25%, 33%, and 40% tone). As described before, in this specific example, the first correspondence data (reference patch of 30% tone) and the second correspondence data (reference patch of 50% tone) are prepared. Hence, the CPU 81 determines that the reference patch of 30% tone of the first correspondence data is the closest to the 33% tone patch. Thus, the 33% tone patches are replaced with 30% tone patches. However, note that this change is unnecessary if correspondence data with 33% tone reference patch is prepared.

Figure 9:
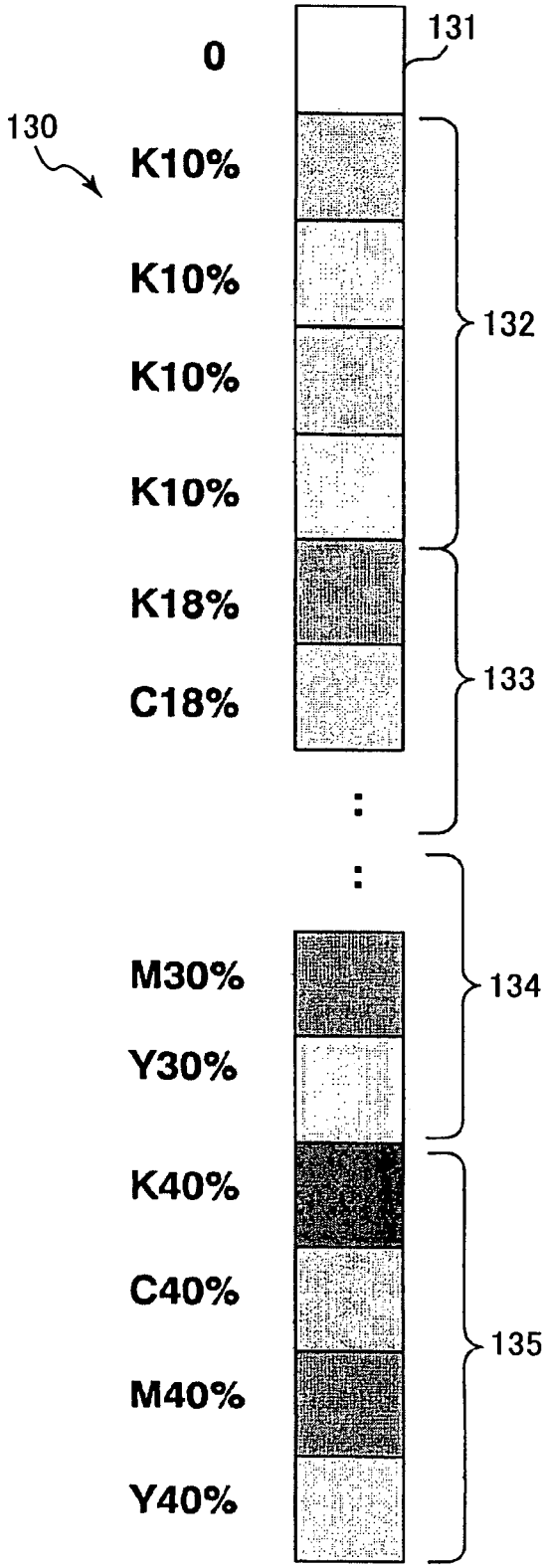
FIG. 9 is an explanatory diagram showing measurement patches used in the calibration process.

As shown in FIG. 9, the above-described process results in a patch column 130 including a 0% tone patch 131 used in common for each color when measuring color density, a 10% tone patch group 132, an 18% tone patch group 133 (shown in part), a 25% tone patch group (not shown), a 30% tone patch group 134 (shown in part), and a 40% tone patch group 135. Each patch group contains a patch of each color at the same tone. This enables generating the correction data with good precision and efficiency. Accordingly, the CPU 81 can estimate density values of tones outside the range 10% to 40%, based on the 30% tone patches and the first correspondence data with the reference patch of 30% tone. In other words, the CPU 81 calculates estimated density of tones outside the range 10% to 40%.

In summary, if correspondence data having, as a reference patch, one of the patches obtained by dividing a reliable or consistent tone range, is prepared, then the control unit 80 uses the one of the patches as the reference patch. On the other hand, if such correspondence data does not exist, then the control unit 80 replaces one of the patches obtained by dividing the reliable or consistent tone range with a patch having the same tone as the reference patch of existing correspondence data.

As described above, the color laser printer 1 of the present embodiment can estimate the color density of unformed patches, and can therefore reduce the number of patches that have to be formed. The color laser printer 1 therefore requires less time to form and measure the patches, and can reduce the processing time required to generate the correction data (calibration data). The correction data is also highly precise because color density is estimated and the correction data is created based on the correspondence data (data enabling estimating the density of other tones from the density of the reference patch measured by the density detection sensor 71) generated using an external calorimeter that can measure density more precisely than the density detection sensor 71 of the color laser printer 1.

According to the color laser printer 1 in the above-described embodiment, density values for various tones can be obtained by forming only a single patch (reference patch or specific-tone patch) of a certain tone for each color. Further, because the single patch has a tone that can be measured consistently and reliably by the density detection sensor 71, the density values for various tones can be obtained with good precision.

According to the color laser printer 1 described above, density values can be obtained for a greater number of patches than the number of patches that are actually formed. Accordingly, the color laser printer 1 can reduce the number of patches that need to be formed. Thus, the color laser printer 1 can adopt a construction that is adapted for the reduced number of patches to be formed.

Further, the control unit 80 can calculate correction values for obtaining ideal density. Thus, the image forming unit 9 can form images with appropriate density. In other words, the color laser printer 1 can form images of density as requested by the personal computer 91 connected to the color laser printer 1.

According to the color laser printer 1 in the above-described embodiment, the control unit 80 calculates the correspondence data using both the measurements of the density detection sensor 71 and the measurements of the external calorimeter. Since the density detection sensor 71 is provided in the color laser printer 1, the density detection sensor 71 has relatively high restriction in costs. In contrast, since the external calorimeter is owned, for example, by a printer manufacturer, its cost is less important. Therefore, the manufacturer can prepare the correspondence data using the external calorimeter 92 with high accuracy and store the correspondence data in the control unit 80 of the color laser printer 1. On the other hand, the manufacturer can use the density detection sensor 71 with relatively less accurate performance in a specific tone range, in the color laser printer 1. In general, a density sensor or calorimeter with high accuracy is expensive. Thus, with the above-described construction, cost of the color laser printer 1 can be reduced.

According to the color laser printer 1 described above, the external calorimeter 92 measures density of the patches printed on paper. Accordingly, the correspondence data (FIG. 4(*a*)) has density values adapted for density on paper. That is, the color laser printer 1 can print images on paper with improved quality.

In the specific example described above, the range of 10% to 40% is divided into substantially five equal divisions such that the patches are formed at 10%, 18%, 25%, 33%, and 40% tone. Because the density detection sensor 71 and the external calorimeter 92 have a high correlation (FIG. 6), density on paper can be estimated accurately with the correspondence data (FIG. 4(*a*)). In addition, since the range is divided into substantially equal divisions, the correction data can be made accurately.

According to the color laser printer 1 described above, the density detection sensor 71 measures the density of the patches on the intermediate transfer belt 51. Thus, consumption of paper can be saved.

Further, according to the color laser printer 1 described above, the scanner unit 21 exposes the OPC belt 33 such that the electrostatic latent images for the patches in a plurality of colors are arranged in series in a direction in which the intermediate transfer belt 51 moves. Because the intermediate transfer belt 51 moves circularly and passes by the density detection sensor 71, all the patches can be measured by fixedly disposing only one density detection sensor 71

(without providing a density sensor for each of CMYK colors), which can cut costs of the color laser printer 1.

While the invention has been described in detail with reference to the specific embodiment thereof, it would be apparent to those skilled in the art that various changes and modifications may be made therein without departing from the spirit of the invention.

Figure 10:
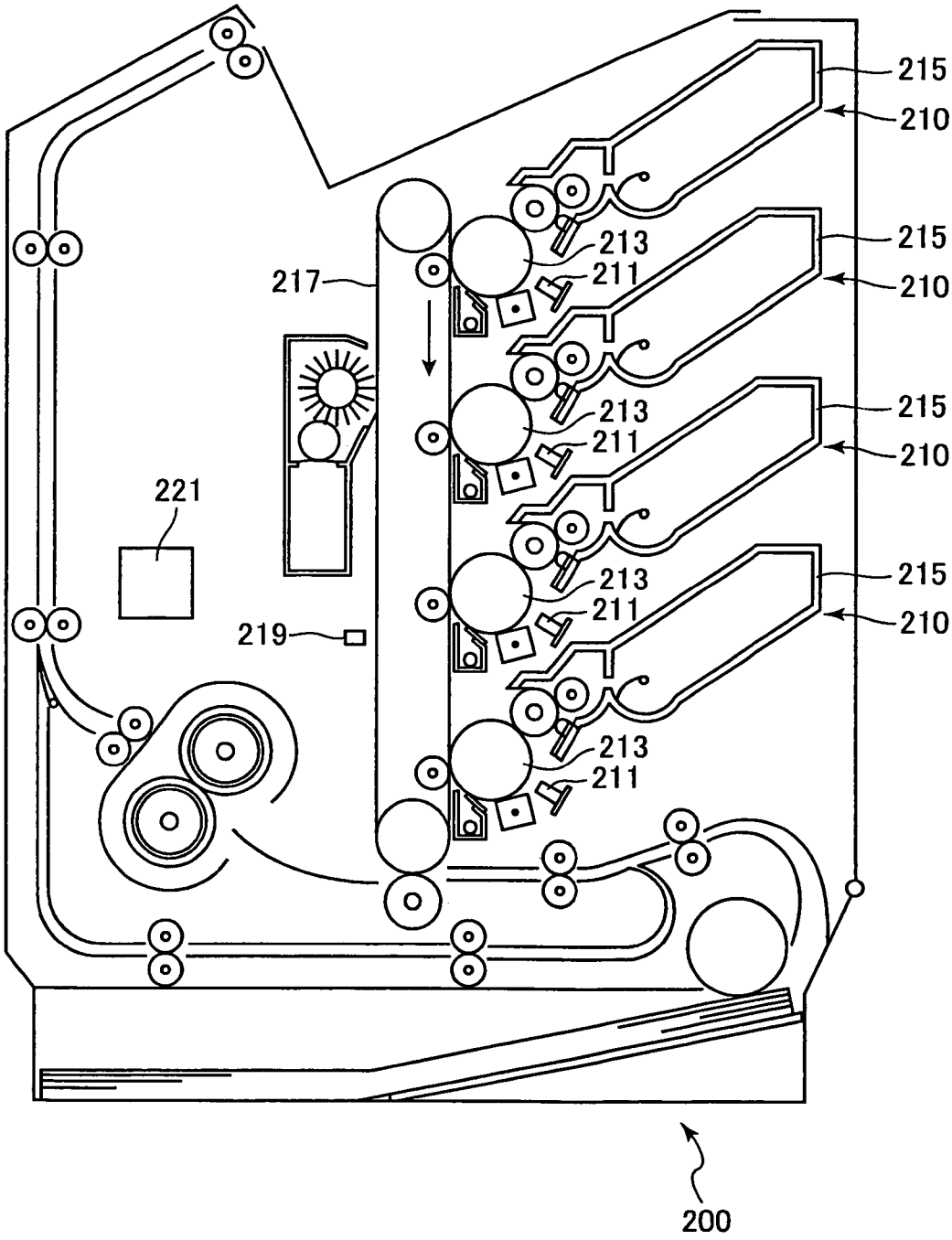
FIG. 10 is a side cross-sectional view showing a tandem color laser printer.

For example, a tandem color laser printer 200 capable of high speed printing is described with reference to FIG. 10. The color laser printer 200 includes a processing unit 210, an intermediate transfer belt (ITB) 217, a density detection sensor 219, and a control unit 221.

The color laser printer 200 includes four processing units 210, one for each color of the CMYK colors. Each processing unit 210 includes a scanner unit 211, a photosensitive drum 213, a developer cartridge 215, and the like. The processing units 210 form a toner image on the intermediate transfer belt 217.

The processing units 210 form full color toner images on the intermediate transfer belt 217 within substantially only one revolution of the belt 217. The intermediate transfer belt 217 then transfers the toner image onto paper.

The density detection sensor 219 has a light source for emitting light in the red spectrum, a lens for directing the emitting light onto the intermediate transfer belt 217, and a phototransistor for detecting light reflected from the belt 217, and thereby measures the density of the toner image on the intermediate transfer belt 217.

The control unit 221 controls other parts of the color laser printer 200, and executes the printing process and calibration process. The calibration process of the present modification is the same as the calibration process performed by the color laser printer 1 in the above-described embodiment (FIG. 2). The processing units 210 thus form measurement patches on the intermediate transfer belt 217 (equivalent to S110 in FIG. 2), and the density detection sensor 219 measures the density of the measurement patches formed on the intermediate transfer belt 217 (equivalent to step S120 in FIG. 2). The same steps as in the calibration process described above are then performed (steps S130 to S150 in FIG. 2), and the control unit 221 generates and stores the correction data.

Therefore, the tandem color laser printer 200 has the same benefits as the four-cycle color laser printer 1 in the above-described embodiment.

Figure 11:
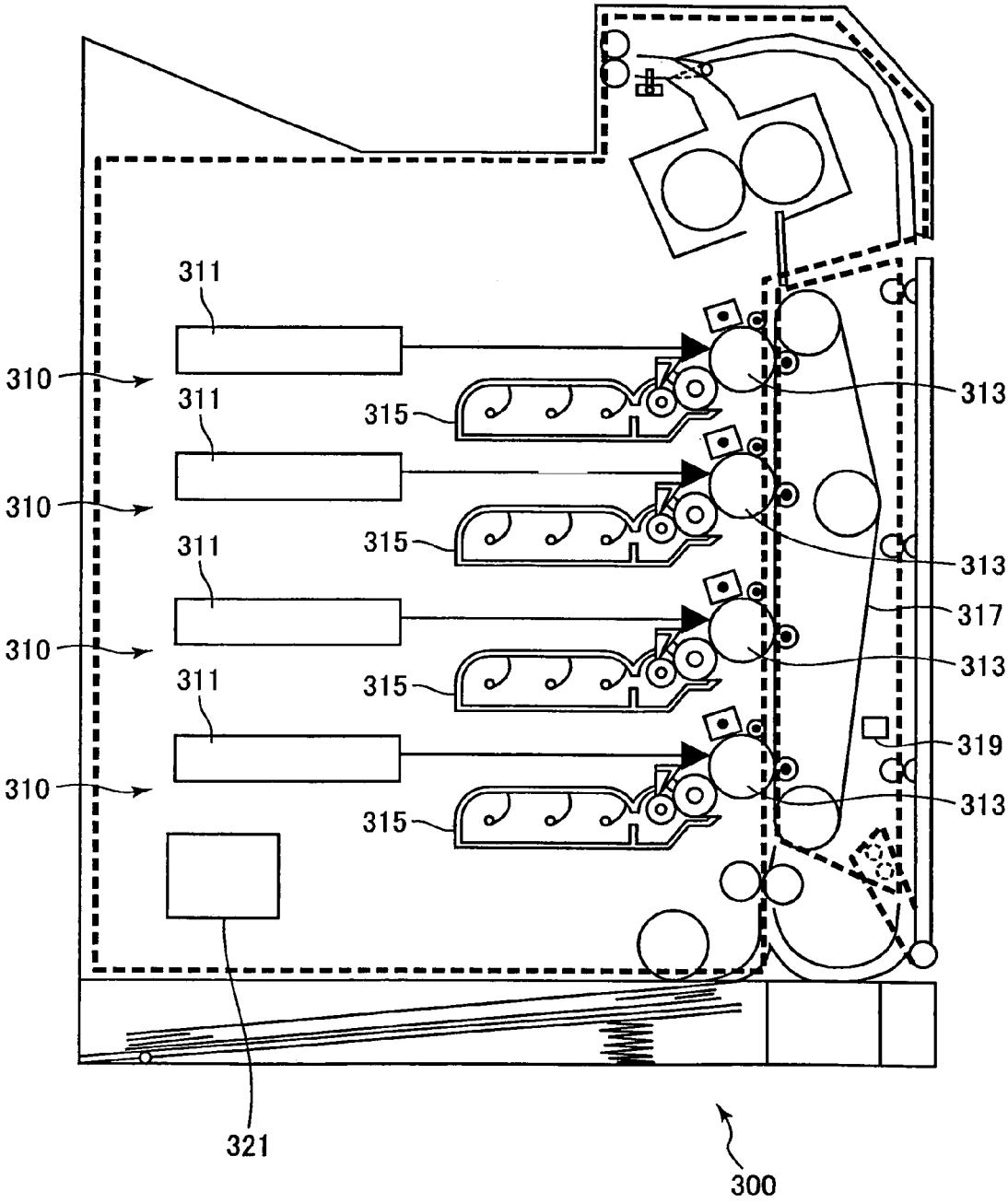
FIG. 11 is a side cross-sectional view showing a direct tandem color laser printer.
Figure 12:
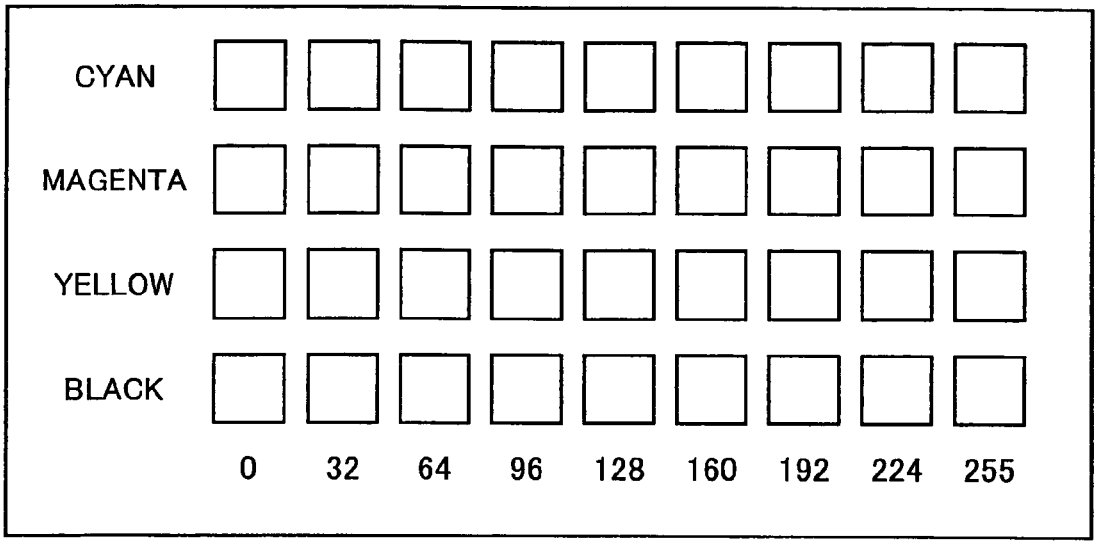
FIG. 12 is an explanatory diagram showing calibration patches (measurement patches) used in a conventional calibration process.

A color laser printer called a direct tandem printer can perform even faster printing than a tandem printer described above. FIG. 11 shows major parts of a direct tandem color laser printer 300 according to another modification. The color laser printer 300 includes a processing unit 310, a transportation belt 317, a density detection sensor 319, and a control unit 321.

The direct tandem color laser printer 300 includes four processing units 310, one for each color of the CMYK colors. Each processing unit 310 includes a scanner unit 311, a photosensitive drum 313, a developer cartridge 315, and the like. The processing units 310 form toner images directly on the paper.

The transportation belt 317 conveys the paper, and the processing units 310 forms the toner image as the paper is transported by the belt 317.

The density detection sensor 319 has a light source for emitting light in the red spectrum, a lens for directing the emitted light onto the transportation belt 317, and a phototransistor for detecting light reflected from the belt, and thereby measures the density of the toner image on the transportation belt 317.

The control unit 321 controls other parts of the color laser printer 300, and executes the printing process and calibration process. The calibration process of the present modification is the same as the calibration process performed by the color laser printer 1 in the above-described embodiment (FIG. 2). During the calibration process the transportation belt 317 does not convey paper, and the processing units 310 form the measurement patches on the transportation belt 317 (equivalent to S110 in FIG. 2). The density of the toner image formed on the transportation belt 317 is then measured by the density detection sensor 319 (equivalent to step S120 in FIG. 2). The same steps as in the calibration process described above are then performed (steps S130 to S150 in FIG. 2), and the control unit 321 thus generates and stores the correction data.

The direct tandem color laser printer 300 therefore has the same benefits as the four-cycle color laser printer 1 in the above-described embodiment.

In the above-described embodiment, the correspondence data with the reference patch of 50% tone is prepared. In the specific example, the first correspondence data with the reference patch of 30% tone and the second correspondence data with the reference patch of 50% tone are prepared. In this way, either a single or a plurality of correspondence data may be prepared, as long as a tone that can be measured consistently or reliably with the density detection sensor 71 is used as the reference patch tone.

In the above-described embodiment, the color laser printer 1 having the four (cyan, magenta, yellow, and black) developer cartridges 35 is described. However, a monochrome printer with a single developer cartridge may also be used.

What is claimed is:

1. An image forming device comprising:

an image forming portion forming, based on data indicative of tones in a predetermined entire tone range, at least one measurement patch for density correction each having density, the at least one measurement patch including at least one specific-tone patch each corresponding to a specific tone;

a first density-measurement unit measuring the density of the at least one measurement patch;

a storage portion storing estimation data for estimating, based on the density of the at least one specific-tone patch, density of at least one other-tone patch having a tone different from the tone of the at least one measurement patch, wherein the at least one other-tone patch has a same color as the at least one measurement patch; and an estimating portion estimating the density of the at least one other-tone patch, based on both the estimation data and the density of the at least one specific-tone patch measured by the first density-measurement unit, wherein the estimating portion estimates the density of the at least one other-tone patch that is not formed.

2. The image forming device as claimed in claim 1, wherein the at least one measurement patch includes a plurality of measurement patches having different tones, the tones of the plurality of measurement patches defining a measurement-patch tone range; and wherein the tone of the at least one other-tone patch is outside the measurement-patch tone range.

3. The image forming device as claimed in claim 1, wherein the estimation data represent a correspondence relationship between the density of the at least one specific-tone patch and the density of the at least one other-tone patch.

4. The image forming device as claimed in claim 1, further comprising:

a correction-data calculating portion calculating correction data based on both the density of the at least one measurement patch measured by the first density-measurement unit and the density of the at least one other-tone patch estimated by the estimating portion, the correction data including data values that convert given tones to corrected tones for obtaining desired density, wherein the image forming portion forms an image based on the corrected tones, thereby obtaining the desired density.

5. The image forming device as claimed in claim 1, wherein the estimation data includes data values obtained based on both first density measurement results and second density measurement results;

wherein the first density measurement results have been obtained for the at least one specific-tone patch by the first density-measurement unit; and wherein the second density measurement results have been obtained for the at least one other-tone patch by an external second density-measurement unit.

6. The image forming device as claimed in claim 5, wherein the image forming portion forms the at least one other-tone patch on a printing medium; and wherein the second density-measurement unit acquires the second density measurement results for the at least one other-tone patch formed on the printing medium.

7. The image forming device as claimed in claim 5, wherein the predetermined entire tone range includes both a first tone range in which the first density-measurement unit and the second density-measurement unit have equivalent density measurement performance and a second tone range in which the first density-measurement unit and the second density-measurement unit have different density measurement performance; and wherein the specific tone of the at least one specific-tone patch is selected from within the first tone range.

8. The image forming device as claimed in claim 7, wherein the at least one measurement patch includes a plurality of measurement patches with substantially equally spaced tones in the first tone range.

9. The image forming device as claimed in claim 5, wherein the predetermined entire tone range includes an upper tone range and a lower tone range, the upper tone range including tones higher than a center tone level at a substantially center of the predetermined entire tone range, the lower tone range including tones lower than the center tone level; and wherein the specific tone of the at least one specific-tone patch is included in the lower tone range.

10. The image forming device as claimed in claim 1, further comprising a determination portion determining the specific tone of the at least one specific-tone patch, wherein the image forming portion forms a plurality of candidate specific-tone patches each having density;

wherein the first density-measurement unit measures the density of each candidate specific-tone patch a plurality of times, thereby obtaining, for each candidate specific-tone patch, a variation in density in the plurality of measurements; and wherein the determination portion identifies the at least one candidate specific-tone patch having the variation in density smaller than the variation in density of other candidate specific-tone patch, and determines the identified at least one candidate specific-tone patch as the at least one specific-tone patch.

11. The image forming device as claimed in claim 5, wherein the image forming portion includes:

an exposure portion forming an electrostatic latent image;

an image bearing member bearing a developer image developed based on the electrostatic latent image formed by the exposure portion; and a transfer portion transferring the developer image to a printing medium.

12. The image forming device as claimed in claim 11, wherein the first density-measurement umt measures the density of the developer image on the image bearing member, the developer image including the at least one measurement patch.

13. The image forming device as claimed in claim 11, wherein the exposure portion exposes the image bearing member, allowing the electrostatic latent image for the at least one measurement patch in a plurality of colors to be arranged in series in a direction in which the image bearing member moves.

14. The image forming device as claimed in claim 11, further comprising a transportation belt for transporting the printing medium, wherein the transfer portion transfers the developer image on the image bearing member to the transportation belt; and wherein the first density-measurement unit measures the density of the developer image on the transportation belt.

15. The image forming device as claimed in claim 14, wherein the exposure portion exposes the image bearing member, allowing the electrostatic latent image for the at least one measurement patch in a plurality of colors to be arranged in series in a direction in which the transportation belt moves.

16. An image forming device comprising:

an image forming portion forming, based on data indicative of tones in each of a plurality of colors, measurement patches for density correction in the plurality of colors, each of the measurement patches having density, the measurement patches in each color including a specific-tone patch corresponding to a specific tone;

a first density-measurement unit measuring the densities of the measurement patches in the plurality of colors;

a storage portion storing estimation data for each color for estimating, based on the density of the specific-tone patch, densities of other-tone patches having tones different from the tones of the measurement patches, wherein the at least one other-tone patch has a same color as the at least one measurement patch; and an estimating portion estimating, for each color, the densities of the other-tone patches, based on both the estimation data and the density of the specific-tone patch measured by the first density-measurement unit, wherein the estimating portion estimates the density of the at least one other-tone patch that is not formed.

17. An image forming device comprising:

an image forming portion forming, based on data indicative of tones in a predetermined entire tone range, at least one measurement patch for density correction each having density, the at least one measurement patch including at least one specific-tone patch each corresponding to a specific tone;

a first density-measurement unit measuring the density of the at least one measurement patch;

a storage portion stonng estimation data tor estimating, based on the density ot the at least one specific-tone patch, density of at least one other-tone patch having a tone different from the tone of the at least one measurement patch; and an estimating portion estimating the density of the at least one other-tone patch, based on both the estimation data and the density of the at least one specific-tone patch measured by the first density-measurement unit, wherein the estimating portion estimates the density of the at least one other-tone patch that is not formed.

* * * * *